US012599247B1

(12) United States Patent
Tang

(10) Patent No.: US 12,599,247 B1
(45) Date of Patent: Apr. 14, 2026

(54) UNIVERSAL BED SHEET RETAINING DEVICE

(71) Applicants: Laisong Tang, Dongguan (CN); Weihan Guo, Dongguan (CN)

(72) Inventor: Laisong Tang, Dongguan City (CN)

( * ) Notice: Subject to any disclaimer, the term of this patent is extended or adjusted under 35 U.S.C. 154(b) by 0 days.

(21) Appl. No.: 19/400,373

(22) Filed: Nov. 25, 2025

(30) Foreign Application Priority Data

Dec. 27, 2024 (CN) ..... 202423238967.1

(51) Int. Cl.
*A47C 21/02* (2006.01)

(52) U.S. Cl.
CPC ..... *A47C 21/022* (2013.01)

(58) Field of Classification Search
CPC ..... Y10T 24/23; A47C 21/028; A47C 21/02; A47C 21/022
See application file for complete search history.

(56) References Cited

U.S. PATENT DOCUMENTS

| | | | | |
|---|---|---|---|---|
| D1,088,644 | S * | 8/2025 | Li | D6/607 |
| D1,090,118 | S * | 8/2025 | Wu | D6/607 |
| 12,446,706 | B1 * | 10/2025 | Lai | A47C 21/022 |
| 12,465,152 | B1 * | 11/2025 | Lewis | A47C 21/022 |
| 2025/0098868 | A1 * | 3/2025 | Lewis | A47C 21/022 |

* cited by examiner

*Primary Examiner* — Jack W Lavinder

(57) ABSTRACT

The present invention discloses a universal bed sheet retaining device. The device comprises a force-bearing base plate having a generally square configuration. Two adjacent sides of the top surface of the force-bearing base plate are respectively provided with a contact support plate. The top end of each contact support plate is provided with an arc-shaped bent plate, and one end of the arc-shaped bent plate away from the contact support plate is fixedly connected to a fixed insertion plate. The device further comprises a positioning box configured to slidably engage with the fixed insertion plate, for securing a bed sheet between the fixed insertion plate and the positioning box.

7 Claims, 10 Drawing Sheets

UNIVERSAL BED SHEET RETAINING DEVICE

FIELD OF THE APPLICATION

The present invention pertains to the technical field of household goods, and particularly relates to a universal bed sheet retaining device.

BACKGROUND

In daily life, bed sheets spread over mattresses, particularly flat sheets other than fitted sheets, are highly prone to dislodgment, wrinkling, or curling during use due to movements such as turning over or getting up. This not only affects the aesthetics and neatness of the bedding but also necessitates frequent readjustment by the user, thereby diminishing the overall sleep experience.

Currently, various products for securing bed sheets are available on the market, such as fitted sheets with elastic edges or separate sheet clips/fasteners. However, fitted sheets often need to be selected according to mattress thickness, offering limited universality, and are less convenient to remove and wash compared to flat sheets. Existing separate clips or straps frequently provide inadequate securing performance, as they may loosen under uneven force distribution. Some products feature complex structures, making installation and removal inconvenient, while others utilize rigid materials or sharp components, which may risk damaging the sheets or causing discomfort during sleep.

Therefore, to address the above technical problems, a universal bed sheet retaining device has been designed.

SUMMARY

The technical problem to be solved by the present invention is to overcome the deficiencies of the prior art and provide a universal bed sheet retaining device.

To solve the above technical problem, the technical solution provided by the present invention is a universal bed sheet retaining device, comprising:

A force-bearing base plate, wherein the force-bearing base plate has a generally square configuration.

Two adjacent sides of a top surface of the force-bearing base plate are respectively provided with a contact support plate. A top end of each contact support plate is provided with an arc-shaped bent plate, and one end of the arc-shaped bent plate away from the contact support plate is fixedly connected to a fixed insertion plate.

The device further comprises a positioning box configured to slidably engage with the fixed insertion plate, for securing a bed sheet between the fixed insertion plate and the positioning box.

The positioning box comprises a back plate and connecting plates symmetrically provided on upper and lower sides of the back plate. One end of each connecting plate away from the back plate is provided with a limiting plate parallel to the back plate. One end of the back plate and the two connecting plates is provided with an insertion slot for allowing the positioning box to be slid onto the fixed insertion plate. Another end of the back plate and the two connecting plates is provided with a stopping portion, which cooperates with the fixed insertion plate.

The top surface of the force-bearing base plate is provided with an internal groove, and a top surface of the internal groove is provided with a plurality of sets of anti-slip lugs arranged at equal intervals.

In some embodiments, a center of the force-bearing base plate is penetrated and provided with a center hole.

In some embodiments, the top surface of the force-bearing base plate is fixedly provided with a height-raising bent plate between the two sets of contact support plates. An outer side of each contact support plate is respectively provided with a plurality of pressure distribution plates, and an outer side of the height-raising bent plate is provided with a reinforcing bent plate.

In some embodiments, an outer side surface of the back plate is provided with a push-pull film tab. An outer side surface of the push-pull film tab is integrally formed with a plurality of sets of triangular indicator points, and a tip of each triangular indicator point faces toward the insertion slot.

In some embodiments, the back plate and the fixed insertion plate have identical shapes, both being elongated structures with rounded ends, and the two connecting plates are arranged in parallel.

In some embodiments, corresponding sides of the limiting plates are provided with a plurality of corrugated grooves arranged at equal intervals.

In some embodiments, when the positioning box is slidably inserted into the insertion slot, a surface of the fixed insertion plate does not contact an inner wall of the positioning box.

The present invention offers the following advantages over the prior art:

1. By inserting the force-bearing base plate beneath the mattress, the bed sheet retaining device is secured by the mattress's weight. The bed sheet is then positioned externally against the fixed insertion plate, which resides between the sheet and the mattress. The positioning box is then slid onto the fixed insertion plate from the insertion slot end. During this process, the positioning box compresses the bed sheet, pressing both sides of the sheet firmly against the fixed insertion plate and the inner wall of the positioning box, respectively. As the positioning box is fully slid onto the fixed insertion plate until it completely encloses the latter, the enclosed bed sheet becomes constrained and securely locked within the device. This mechanism effectively confines the sheet, is simple and quick to operate, provides a firm hold, and effectively prevents displacement, wrinkling, or curling during use, maintaining a smooth and tidy bed surface.
2. The internal groove on the surface of the force-bearing base plate, along with the anti-slip lugs within it, provides excellent anti-slip properties. This further stabilizes the bed sheet retaining device, preventing it from sliding out from under the mattress, thereby better maintaining the smooth and flat state of the bed sheet.
3. The positioning box of the present invention is ingeniously designed. The slidable engagement facilitates easy installation and removal. The push-pull film tab and triangular indicator points aid in applying force and identifying the insertion direction. The corrugated grooves on the limiting plates increase friction with the bed sheet, preventing slippage at the clamping point.
4. Furthermore, the arranged contact support plates and height-raising bent plate conform to the mattress surface, enabling the bed sheet to be pressed down snugly against the mattress. This results in a smoother appearance along the sides of the bed sheet.

5. The overall structural design considers user comfort and safety. It incorporates no sharp components, avoiding potential damage to the bed sheet or any discomfort to the user.

BRIEF DESCRIPTION OF THE DRAWINGS

As shown in FIGS. 1-10:

1. Force-bearing base plate; 2. Center hole; 3. Internal groove; 4. Anti-slip lug; 5. Contact support plate; 6. Height-raising bent plate; 7. Fixed insertion plate; 8. Pressure distribution plate; 9. Reinforcing bent plate; 10. Positioning box; 11. Push-pull film tab; 12. Insertion slot; 13. Limiting plate; 14. Corrugated groove; 15. Arc-shaped bent plate; 16. Back plate; 17. Connection plate; 18. Stopping portion; 19. Triangular indicator point.

While the technology is susceptible to various modifications and alternative forms, specifics thereof have been shown by way of example and drawings, and will be described in detail. It should be understood, however, that the application is not limited to the particular embodiments described. On the contrary, the application is to cover modifications, equivalents, and alternatives falling within the spirit and scope of the technology.

DETAILED DESCRIPTION OF EMBODIMENTS

The embodiments of the present technology described herein are not intended to be exhaustive or to limit the technology to the precise forms disclosed in the following detailed description. Rather, the embodiments are chosen and described so that others skilled in the art can appreciate and understand the principles and practices of the present technology. All publications and patents mentioned herein are hereby incorporated by reference. The publications and patents disclosed herein are provided solely for their disclosure. Nothing herein is to be construed as an admission that the inventors are not entitled to antedate any publication and/or patent, including any publication and/or patent cited herein.

A detailed description of a universal bed sheet retaining device according to the present invention will now be provided with reference to the accompanying drawings.

Figure 1:
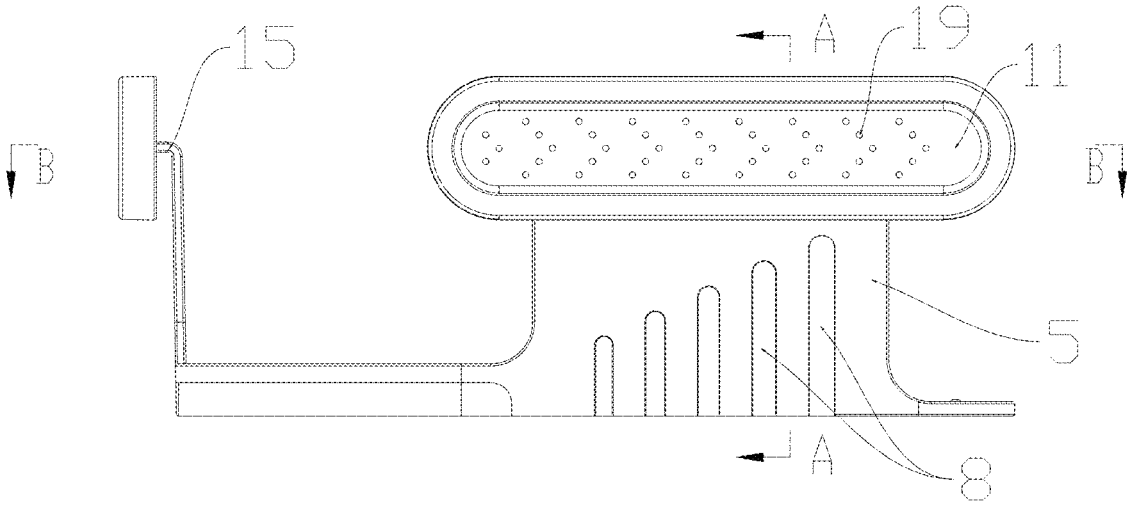
FIG. 1 is a side view of a universal bed sheet retaining device according to the present invention.
Figure 2:
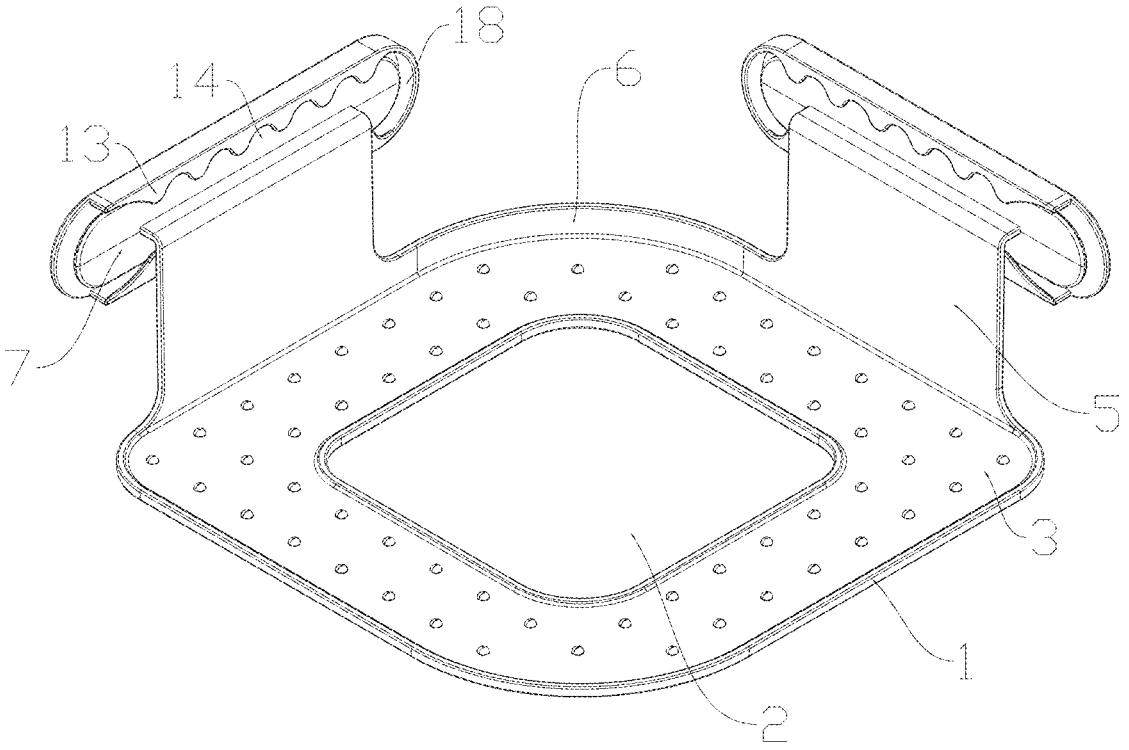
FIG. 2 is a first top perspective view of the universal bed sheet retaining device according to the present invention.
Figure 3:
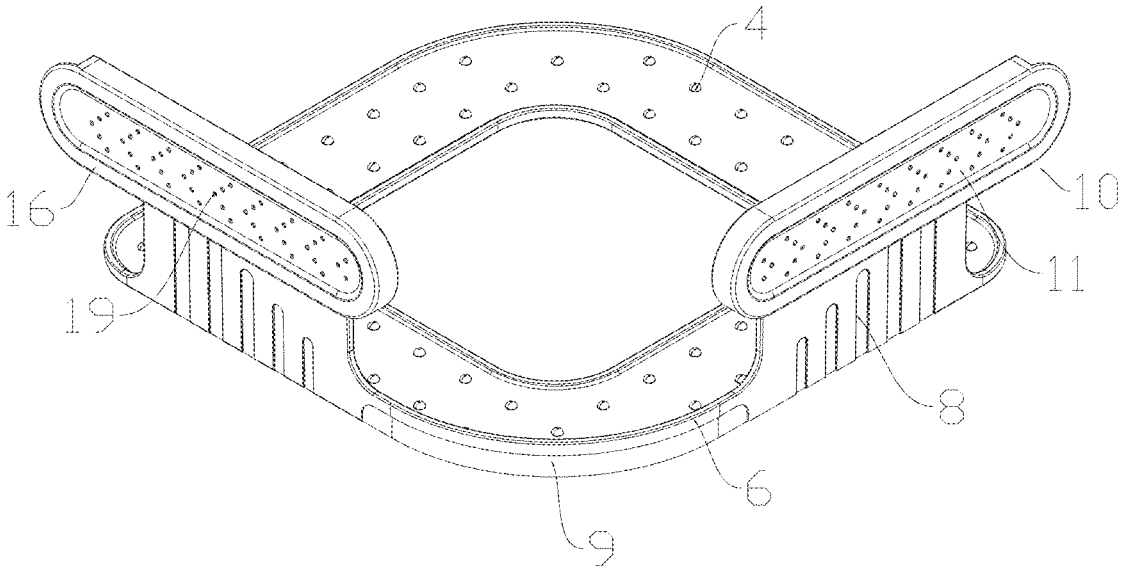
FIG. 3 is a second top perspective view of the universal bed sheet retaining device according to the present invention.
Figure 4:
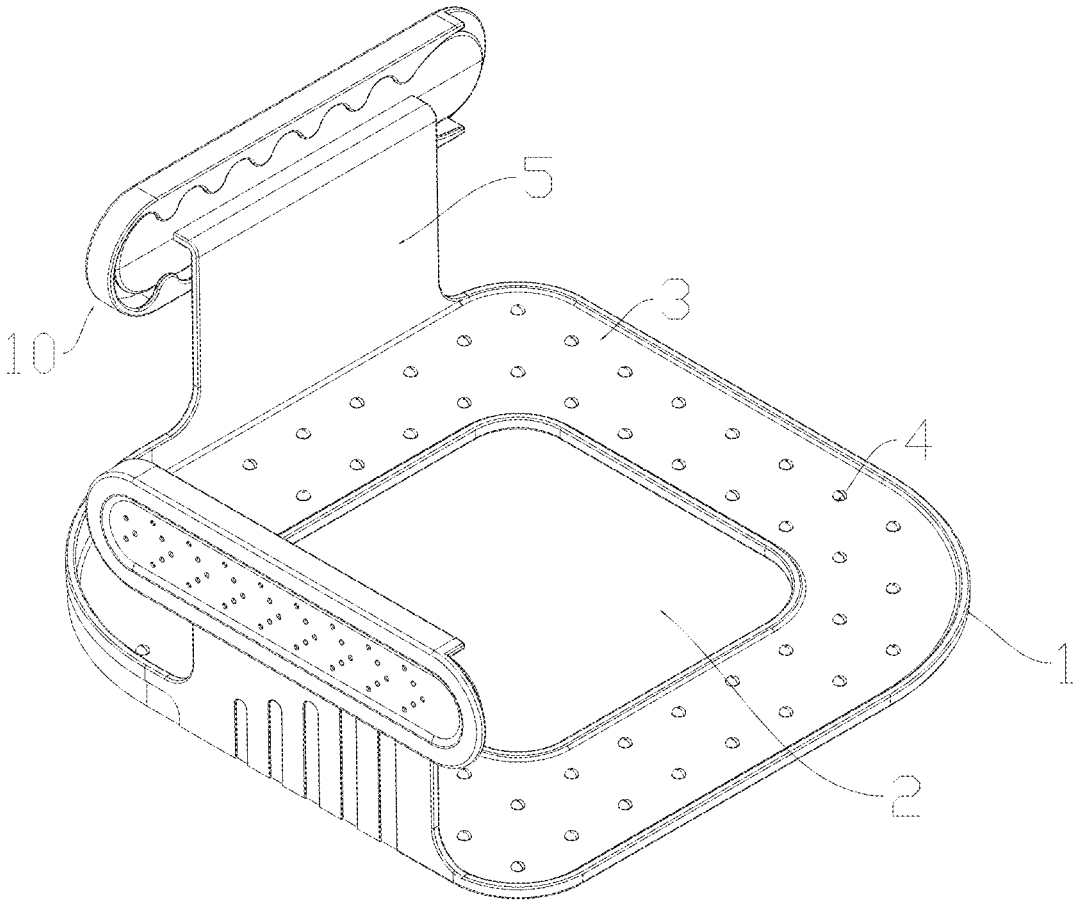
FIG. 4 is a third top perspective view of the universal bed sheet retaining device according to the present invention.
Figure 5:
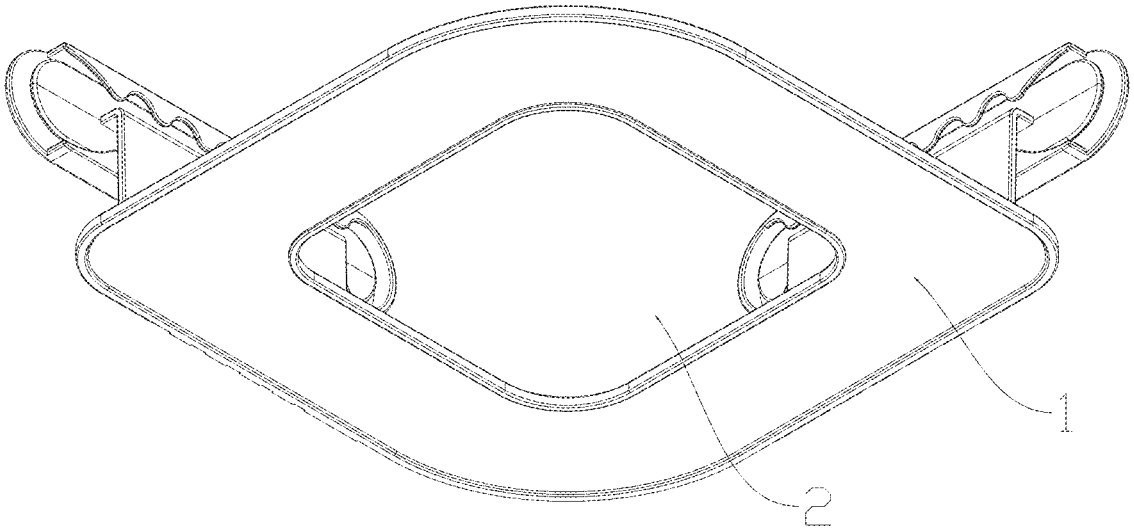
FIG. 5 is a bottom perspective view of the universal bed sheet retaining device according to the present invention.
Figure 6:
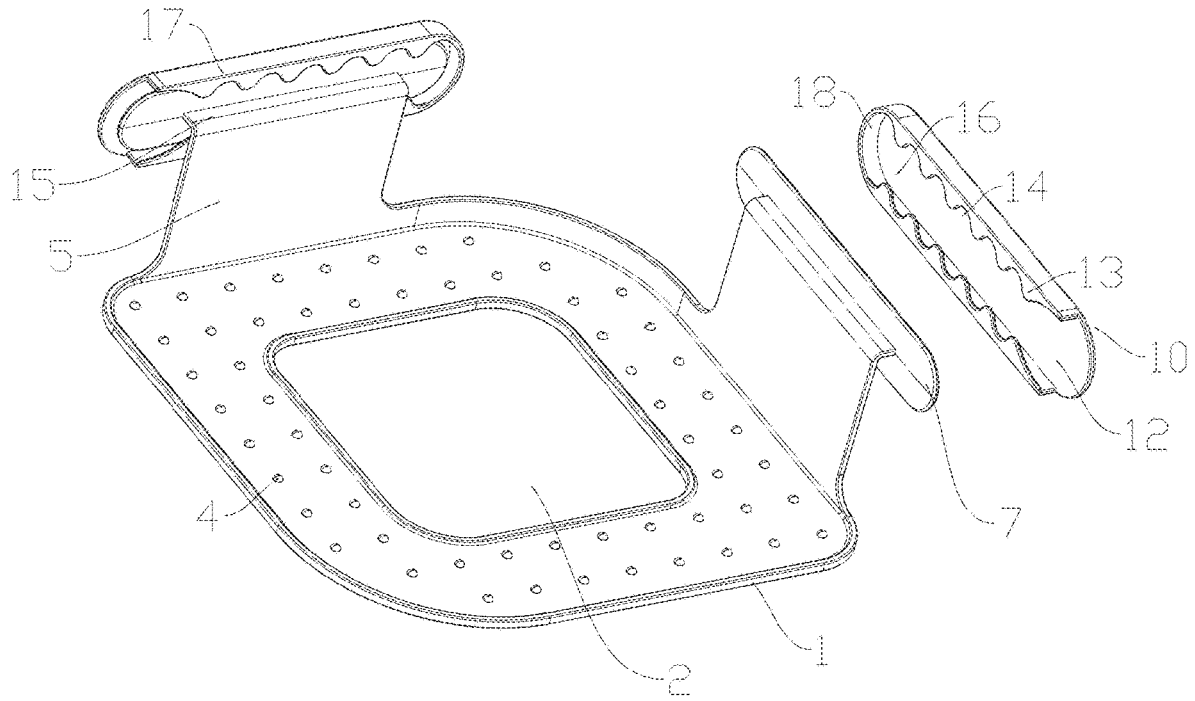
FIG. 6 is a reference diagram of the universal bed sheet retaining device in an engaged state.
Figure 7:
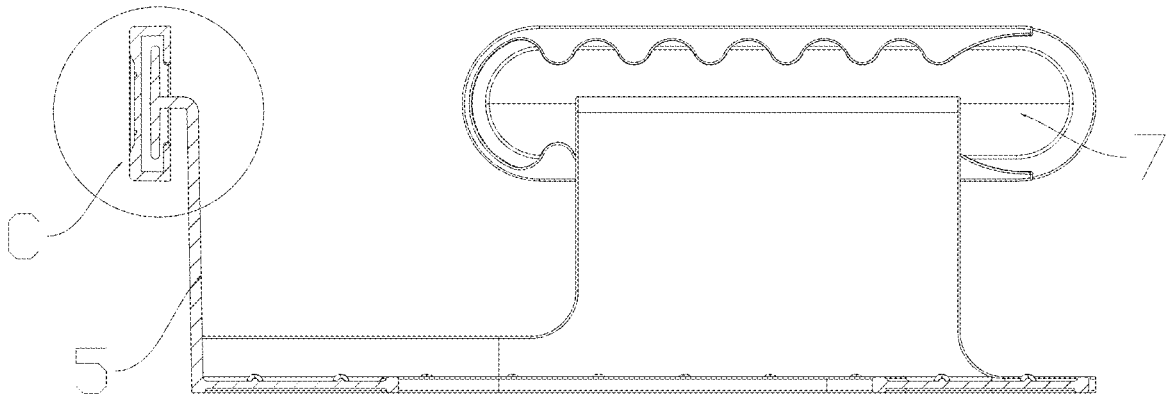
FIG. 7 is a cross-sectional view taken along line A-A in FIG. 1.
Figure 8:
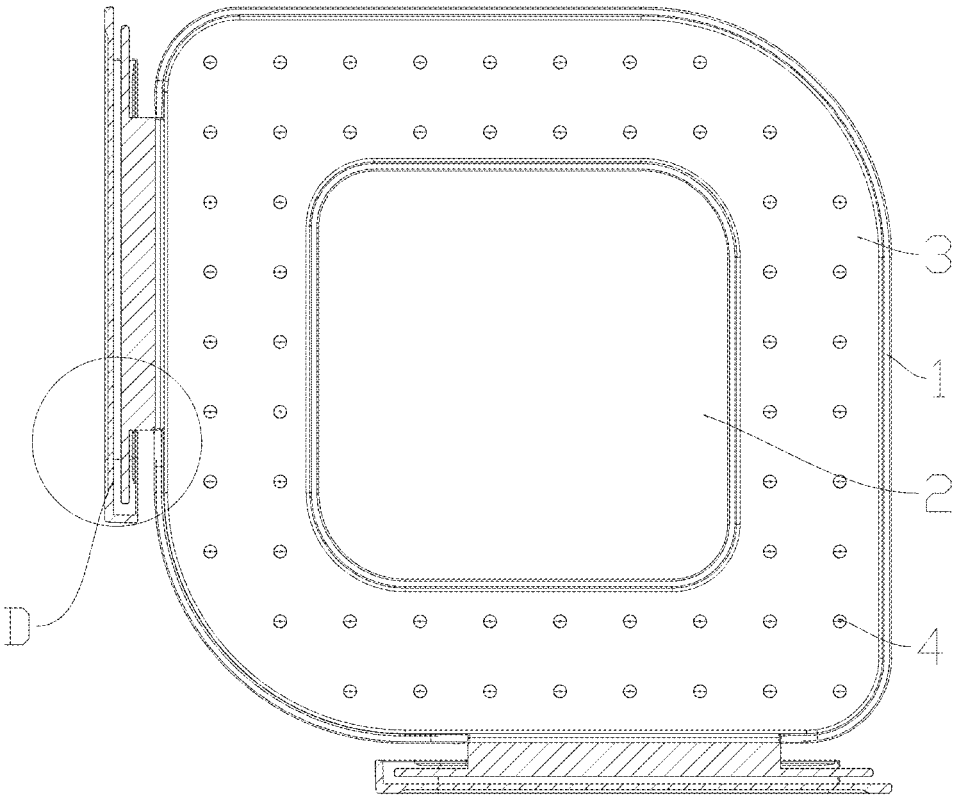
FIG. 8 is a cross-sectional view taken along line B-B in FIG. 1.
Figure 9:
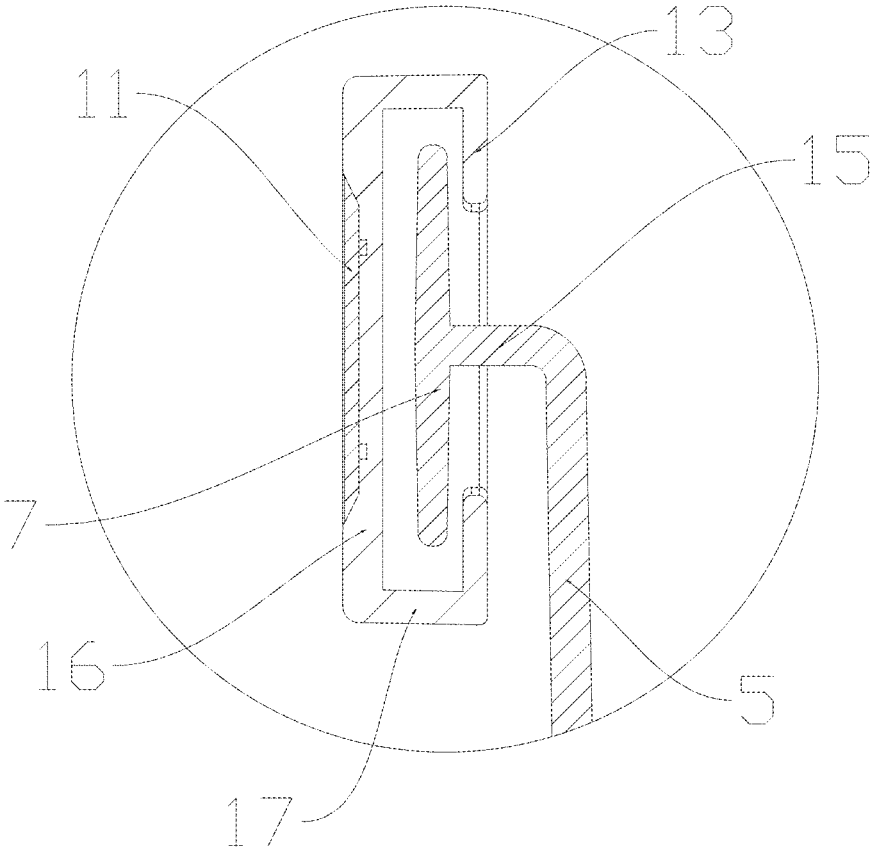
FIG. 9 is a partially enlarged view of section C in FIG. 7.
Figure 10:
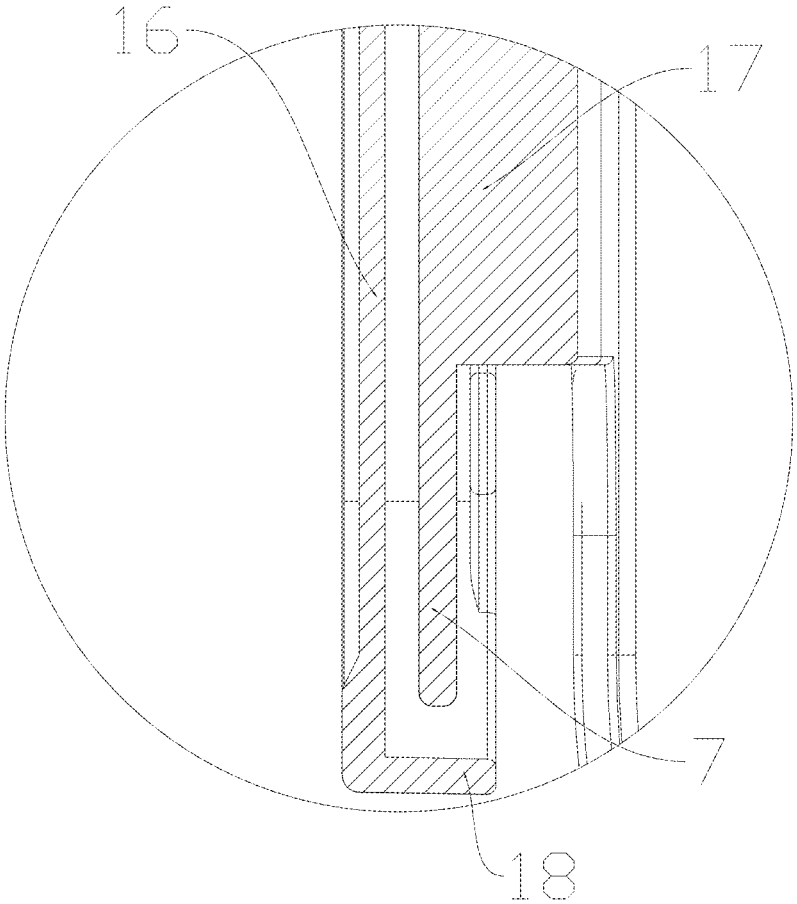
FIG. 10 is a partially enlarged view of section D in FIG. 8.

With reference to FIGS. 1-10, a universal bed sheet retaining device comprises a force-bearing base plate 1, which has a generally square configuration.

Specifically, the force-bearing base plate 1 is designed to be inserted between the mattress and the bed frame. It is primarily secured by the weight of the mattress pressing down upon it.

To enhance the anti-slip effect and prevent the force-bearing base plate 1 from being easily pulled out, its top surface is provided with an internal groove 3. The top surface of the internal groove 3 is provided with a plurality of sets of anti-slip lugs 4 arranged at equal intervals. These anti-slip lugs 4 increase friction with the bottom surface of the mattress.

Two adjacent sides of the top surface of the force-bearing base plate 1 respectively are provided with a contact support plate 5 extending vertically upward. During use, the inner side of each contact support plate 5 contacts the side surface of the mattress. The top end of each contact support plate 5 is provided with an arc-shaped bent plate 15. One end of the arc-shaped bent plate 15 away from the contact support plate 5 is fixedly connected to a fixed insertion plate 7.

The design of the arc-shaped bent plate 15 maintains a certain distance between the fixed insertion plate 7 and the upper edge of the mattress, reserving space for the passage of the bed sheet and the insertion of the positioning box 10. The fixed insertion plate 7 serves as one fixed surface for clamping the bed sheet.

The device further comprises a positioning box 10 configured to slidably engage with the fixed insertion plate 7, for securing a bed sheet between the fixed insertion plate 7 and the positioning box 10.

The positioning box 10 comprises a back plate 16 and connecting plates 17 symmetrically provided on the upper and lower sides of the back plate 16. The two connecting plates 17 are arranged in parallel. One end of each connecting plate 17 away from the back plate 16 is provided with a limiting plate 13 parallel to the back plate 16. One end of the back plate 16 and the two connecting plates 17 is provided with an insertion slot 12 for allowing the positioning box 10 to be slid onto the fixed insertion plate 7. Another end of the back plate 16 and the two connecting plates 17 is provided with a stopping portion 18, which cooperates with the fixed insertion plate 7.

Thus, the back plate 16, the two connecting plates 17, and the limiting plates 13 collectively form a partially enclosed, approximately U-shaped or box-like structure, open at one end (the insertion slot 12) and closed on three sides. The positioning box 10 is slid onto the fixed insertion plate 7 via this insertion slot 12. When the positioning box 10 is fully slid onto the fixed insertion plate 7, the end of the fixed insertion plate 7 abuts against the stopping portion 18, preventing over-insertion or disengagement from the opposite end.

A center hole 2 penetrates the center of the force-bearing base plate 1. This design helps reduce product weight, save material, and may also aid air circulation to some extent.

To enhance the structural strength of the force-bearing base plate 1, its top surface is fixedly provided with a height-raising bent plate 6 located between the two sets of contact support plates 5. The outer side of each contact support plate 5 is respectively provided with a plurality of pressure distribution plates 8. The outer side of the height-raising bent plate 6 is provided with a reinforcing bent plate 9.

These reinforcing structures help distribute the pressure applied by the mattress, preventing deformation of the force-bearing base plate 1 or the contact support plates 5 under long-term compression.

An outer side surface of the back plate 16 is provided with a push-pull film tab 11. An outer side surface of the push-pull film tab 11 is integrally formed with a plurality of sets of triangular indicator points 19. A tip of each triangular indicator point 19 faces toward the insertion slot 12, serving to indicate the insertion direction.

The push-pull film tab 11 is typically made from materials with a high coefficient of friction, such as rubber or silicone, to facilitate the application of force by the user during insertion and removal operations.

The back plate 16 and the fixed insertion plate 7 have identical shapes, both being elongated structures with rounded ends. This streamlined design lacks sharp edges, enhancing safety during use.

Corresponding sides of the limiting plates 13 are provided with a plurality of corrugated grooves 14 arranged at equal intervals. These corrugated grooves 14 provide additional gripping force when clamping the bed sheet, preventing the sheet from sliding within the clamping area.

A key design feature is that when the positioning box 10 is slidably inserted into the insertion slot 12, the surface of the fixed insertion plate 7 does not contact the inner wall of the positioning box 10. This gap is precisely intended to accommodate and clamp the thickness of the bed sheet. If the fixed insertion plate 7 directly contacted the inner wall of the positioning box 10, effective clamping of the bed sheet would not be achieved.

During specific implementation of the present invention, the operational procedure is as follows:

Base Installation: The force-bearing base plate 1 is inserted beneath the edge at each corner of the mattress, ensuring the contact support plates 5 snugly fit against the side surfaces of the mattress. The weight of the mattress secures the force-bearing base plate 1 in place, while the internal groove 3 and anti-slip lugs 4 provide additional anti-slip resistance.

Sheet Placement: The bed sheet B is spread smoothly over the mattress. The edge portion of the bed sheet B to be secured is drawn over the outside of the fixed insertion plate 7, such that the fixed insertion plate 7 is positioned between the bed sheet and the side surface of the mattress.

Clamping and Securing: The user holds the positioning box 10, aligns the insertion slot 12 with the fixed insertion plate 7 according to the direction indicated by the triangular indicator points 19, and then firmly slides the positioning box 10 onto the fixed insertion plate 7. During this process, the bed sheet B is compressed into the gap between the fixed insertion plate 7 and the inner walls of the positioning box 10. The positioning box 10 is slid further on until its stopping portion 18 abuts against the end of the fixed insertion plate 7. At this point, the bed sheet is firmly clamped between the fixed insertion plate 7 and the positioning box 10 (primarily its back plate 16, connecting plates 17, and limiting plates 13). The corrugated grooves 14 on the limiting plates 13 further prevent the bed sheet B from slipping out.

Removal: When replacing or washing the bed sheet, the user simply pinches or presses the push-pull film tab 11 and applies an outward force to detach the positioning box 10 from the fixed insertion plate 7, after which the bed sheet can be freely moved.

In the description of the embodiments of the present invention, it is to be noted that:

Terms such as "center", "upper", "lower", "left", "right", "vertical", "horizontal", "inner", "outer", and the like, which indicate orientations or positional relationships, are based on the orientations or positional relationships shown in the accompanying drawings, or are the customary orientations or positional relationships when the invented product is in use. These terms are used merely to facilitate the description of the present invention and simplify the description, and are not intended to indicate or imply that the referred apparatus or elements must have a specific orientation or be constructed and operated in a specific orientation. Therefore, they should not be construed as limiting the present invention.

Furthermore, terms such as "first", "second", "third", etc., are used solely for distinguishing description and are not to be interpreted as indicating or implying relative importance.

In addition, terms such as "horizontal", "vertical", "perpendicular", etc., do not require that the components be absolutely so oriented, but may include slight inclinations. For example, "horizontal" merely means that its direction is more horizontal relative to "vertical", and does not mean that the structure must be completely level; it can be slightly inclined.

In the description of the embodiments of the present invention, the term "a plurality of" means at least two.

In the description of the embodiments of the present invention, it is also to be noted that, unless otherwise explicitly specified and defined, terms such as "provided", "mounted", "attached", "connected" should be interpreted broadly. For example, a "connection" may be a fixed connection, a detachable connection, or an integral connection; it may be a mechanical connection, an electrical connection, or communicate with each other; it may be a direct connection, or an indirect connection through an intermediary. Those of ordinary skill in the art can understand the specific meanings of these terms in the present invention based on the specific circumstances.

The present invention and its embodiments have been described above. This description is not limiting, and the embodiments shown in the drawings are merely some of the embodiments of the present invention. The actual structure is not limited thereto. In summary, if those of ordinary skill in the art are inspired by the present invention and, without departing from the spirit of the inventive concept, design similar structural configurations and embodiments without creative effort, these should all fall within the protection scope of the present invention.

The invention claimed is:

1. A universal bed sheet retaining device, comprising a force-bearing base plate, wherein the force-bearing base plate has a generally square configuration; two adjacent sides of a top surface of the force-bearing base plate are respectively provided with a contact support plate, a top end of each contact support plate is provided with an arc-shaped bent plate, and one end of the arc-shaped bent plate away from the contact support plate is fixedly connected to a fixed insertion plate;

the device further comprises a positioning box configured to slidably engage with the fixed insertion plate, for securing a bed sheet between the fixed insertion plate and the positioning box;

the positioning box comprises a back plate and connecting plates symmetrically provided on upper and lower sides of the back plate, one end of each connecting plate away from the back plate is provided with a limiting plate parallel to the back plate, one end of the back plate and the two connecting plates is provided with an insertion slot for allowing the positioning box to be slid onto the fixed insertion plate, another end of the back plate and the two connecting plates is provided with a stopping portion, which cooperates with the fixed insertion plate;

the top surface of the force-bearing base plate is provided with an internal groove, and a top surface of the internal groove is provided with a plurality of sets of anti-slip lugs arranged at equal intervals.

2. The universal bed sheet retaining device of claim 1, wherein a center of the force-bearing base plate is penetrated and provided with a center hole.

3. The universal bed sheet retaining device of claim 1, wherein the top surface of the force-bearing base plate is fixedly provided with a height-raising bent plate between the two sets of contact support plates, an outer side of each contact support plate is respectively provided with a plurality of pressure distribution plates, and an outer side of the height-raising bent plate is provided with a reinforcing bent plate.

4. The universal bed sheet retaining device of claim 1, wherein an outer side surface of the back plate is provided with a push-pull film tab, an outer side surface of the push-pull film tab is integrally formed with a plurality of sets of triangular indicator points, and a tip of each triangular indicator point faces toward the insertion slot.

5. The universal bed sheet retaining device of claim 1, wherein the back plate and the fixed insertion plate have identical shapes, both being elongated structures with rounded ends, and the two connecting plates are arranged in parallel.

6. The universal bed sheet retaining device of claim 1, wherein corresponding sides of the limiting plates are provided with a plurality of corrugated grooves arranged at equal intervals.

7. The universal bed sheet retaining device of claim 1, wherein when the positioning box is slidably inserted into the insertion slot, a surface of the fixed insertion plate does not contact an inner wall of the positioning box.

* * * * *